US005311679A

United States Patent [19]

Birch, Sr.

[11] Patent Number: 5,311,679

[45] Date of Patent: May 17, 1994

[54] SHOE POCKET

[76] Inventor: John A. Birch, Sr., 230 Tughland Ave., Marlboro, N.Y. 12542

[21] Appl. No.: 980,973

[22] Filed: Nov. 24, 1992

[51] Int. Cl.[5] ..... A43B 5/00

[52] U.S. Cl. ..... 36/136; 2/919; 206/69

[58] Field of Search ..... 36/1, 132, 136; 206/69; 383/58; 2/249, 251, 252, DIG. 6

[56] References Cited

U.S. PATENT DOCUMENTS

| | | | |
|---|---|---|---|
| 1,786,896 | 12/1930 | Conger | 2/252 X |
| 2,442,415 | 6/1948 | Kubovcik | 2/252 |
| 3,018,570 | 1/1962 | Bliese | 36/136 X |
| 4,507,882 | 4/1985 | Harrell | 36/136 |
| 4,597,198 | 7/1986 | Schweitzer | 36/136 X |
| 4,630,383 | 12/1986 | Gamm | 36/136 |
| 5,042,091 | 8/1991 | Tonkens | 2/DIG. 6 X |
| 5,094,016 | 3/1992 | DiVito | 36/136 |
| 5,117,841 | 6/1992 | McBeth | 206/69 X |

FOREIGN PATENT DOCUMENTS

| | | | |
|---|---|---|---|
| 2139103 | 11/1984 | United Kingdom | 36/132 |

*Primary Examiner*—Paul T. Sewell
*Assistant Examiner*—BethAnne Cicconi
*Attorney, Agent, or Firm*—John B. Dickman, III

[57] ABSTRACT

A shoe pocket for storing articles such as keys, change, etc. when engaging in athletic activities. The shoe-pocket has a pocket section with an open end formed with front and back sides. A flexible loop is attached to the back side for passing between a shoe and its laces and close the open end of the pocket. There is also a removable fastening material secured to the back side which removably fastens to the laces to prevent movement of the shoe pocket when jogging and engaging in other activities.

2 Claims, 1 Drawing Sheet

SHOE POCKET

BACKGROUND OF THE INVENTION

The present invention relates to a shoe-pocket that attaches to the laces of a shoe, and in particular to a shoe-pocket which attaches to the laces by one or more positive engagement systems for quick attachment and detachment.

There is a greater emphasis on athletics today compared to the past generations. An exercise shared by men and women is jogging which requires a minimum of clothing, such as a shirt or jacket, a pair of pants, and athletic shoes. Because of a lack of pockets, joggers are often hard pressed to carry door keys, change or other items which may be needed. Various shoe pockets have been employed to meet these needs. For example, U.S. Pat. Nos. 4,280,287, 4,372,060, 4,507,882, 4,630,383 and 5,094,016 generally describe product devices which are carried on athletic shoes, however, they all suffer from one or more disadvantages.

With the proliferation of the aids virus in today's civilization and the increasing public awareness of the need for the use of a condom in sexual activities, it is imperative that a condom be readily available when needed. Thus, this invention readily lends itself to this situation, as the condom will be available regardless of the presence or absence of pockets or pouches in the jogger's running outfits.

The shoe-pocket shown in U.S. Pat. No. 4,280,287 is attached to an athletic shoe. The shoe pocket is sewn to the shoe on three sides, leaving one side open to receive an object. There is a hook and loop system to close the open side, thereby retaining the object. In another embodiment, a flat sheet with either the hooks or loops of a hook and loop system sewn to the perimeter is removably attached to the other of the hooks or loops permanently attached to the shoe to mate with the hooks or loops of the flat sheet. The problem with either of these embodiments is that the shoe pocket is located on the side of the shoe which may be difficult to reach or the shoe pocket may catch on something that may open the pocket and releasing the object contained therein.

Another shoe pocket permanently attached to an athletic shoe is disclosed in U.S. Pat. No. 4,372,060 where the pocket is integral with the tongue. The tongue has an extra long length with a depression for holding articles. The extra length is folded over covering the articles. A hook and loop system holds the extra length in the folded position to close the depression or pocket. There is a problem with the folded extra length and the depression since the articles may slip out when jogging. Another problem is that the end of the tongue is also held down by the shoe lace, therefore the lace must be untied to uncover the pocket.

U.S. Pat. No. 4,507,882 shows a shoe-pocket attached to the laces of an athletic shoe at one end of the pocket. The problem with this arrangement is that it is attached only at one end of the shoe pocket flaps during running or walking, which creates a distraction.

The shoe-pocket in U.S. Pat. No. 4,630,383 is integrally formed as an extension of the shoe tongue. The tongue folds over the laces with the pocket opening exposed. A loop and hook system is employed to close the pocket. The shoe-pocket is only attached to the shoe tongue, therefore it is free to flap.

An interesting shoe-pocket is shown in U.S. Pat. No. 5,094,016 where the shoe-pocket is attached to the athletic shoe by the shoe laces. There is a loop and hook system for closing the open end of the pocket. Once the shoe-pocket is laced to the shoe it can not be removed without unlacing the shoe.

SUMMARY OF THE PRESENT INVENTION

The shoe pocket of the present invention provides a solution to the aforementioned problems by providing a simple construction and an easy to attach and remove system which wraps around the laces. To accomplish this, the shoe pocket of the present invention includes a pocket formed of a piece of material which is stitched together to form a pocket and a flap sewn to one face of the pocket.

The flap extends over one side and is attached to the other side. The side to which the flap is attached has the hook portion of a loop and hook system which locks onto the fibers of the shoe laces. The flap is passed under the laces and pulled out from under the laces at another position whereby the flap covers the open end of the pocket and closes the pocket by a snap fastener.

It is an object of the present invention to provide an improved shoe pocket for carrying articles such as keys, change, and the like and which is easily manufactured.

Another object of the present invention is to provide an improved shoe pocket which is quickly attached and removed from the laces of an athletic shoe, sneakers and the like.

These and other objects, features and advantages of the present invention will become more readily apparent from the following detailed description, taken in conjunction with accompanying drawings.

DESCRIPTION OF THE INVENTION

Figure 1:
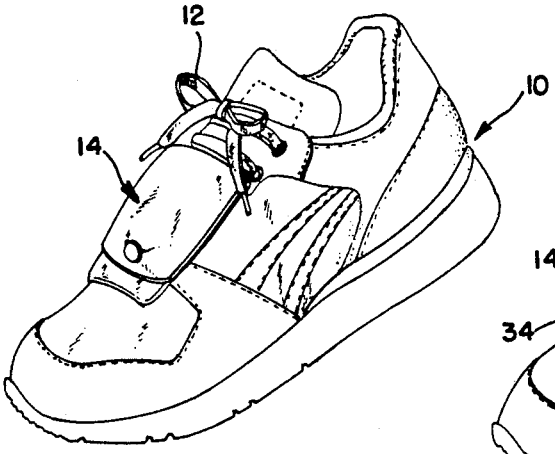
FIG. 1 shows a perspective view of a shoe pocket of the invention.
Figure 2:
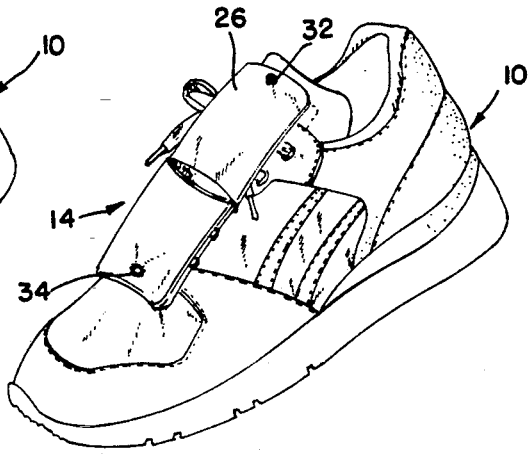
FIG. 2 shows another perspective view of a shoe pocket of the invention.

Referring to the drawings, FIGS. 1–5, there is shown an athletic shoe 10 having laces 12 and a shoe pocket 14 made of leather, soft plastic, fabric or the like, of the invention. In FIGS. 1 and 2 the shoe pocket 14 is shown attached to the athletic shoe 10 for jogging or other activity.

Figure 4:
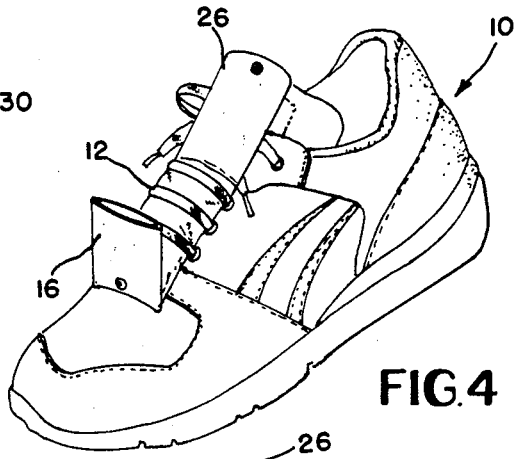
FIG. 4 is a front perspective of a shoe pocket of the invention.
Figure 5:
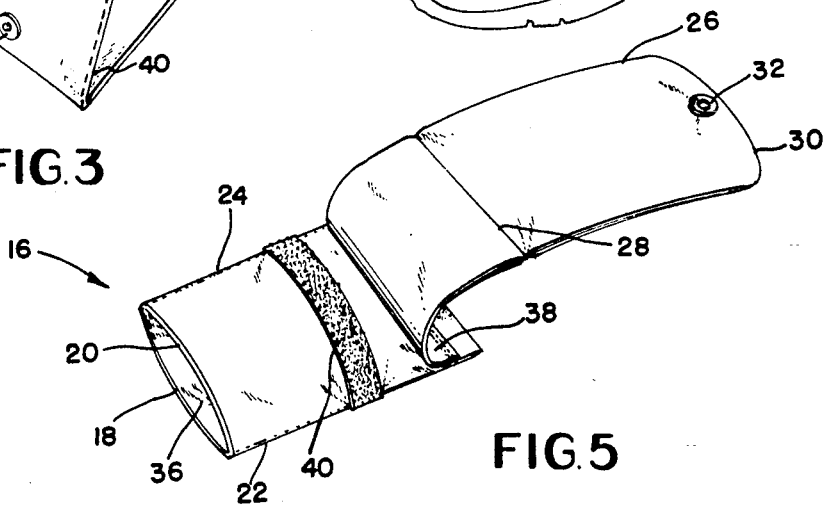
FIG. 5 is a rear perspective of a shoe pocket of the invention.

Shoe pocket 14 is best shown in FIGS. 4 and 5, having a pocket 16 constructed by folding an elongated sheet of material along its peripheral edges to provide a front side 18 and a back side 20, sewn along edges 22 and 24. Attached to the back side 20 at or near where said sheet is folded, is a loop 26 having a fold area 28 to form a U-shape when free end 30 is fastened to the front side 18 of the pocket 16. A pair of snap elements 32 and 34 hold the loop 26 closed. Shoe pocket 14 has an open end 36 which is covered by the closing of loop 26.

FIG. 5 shows the back side 20 of the pocket 16 with the loop 26 attached at 38. Also shown is a hook section 40 of a loop and hook fastening system.

Figure 3:
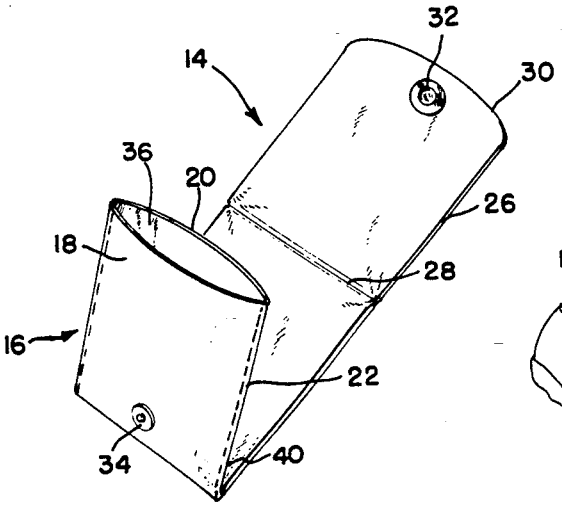
FIG. 3 shows a perspective view of a shoe pocket and shoe laces holding it in place.

In operation, the loop 26 is passed between shoe 10 and laces 12, as in FIG. 3, and pulled tight until the loop 26 and pocket 16 are snug against the laces 12 with attached area 38 of loop 26 and back side 20 catching on the laces. The hook section 40 of a loop and hook fastening system 40 is pressed against the laces 12 fastening to them. The shoe pocket 14 is closed by folding the loop 26 along fold area 28 and joining snaps 32 and 34, as in FIG. 1. To store articles in the shoe pocket 14, the loop 26 is unsnapped as in FIG. 2.

A second embodiment is contemplated in which the back portion of the pocket has hook material formed thereon or attached thereto so that after the flap is passed under the laces, the back portion of the pocket has hook material formed thereon or attached thereto so that the pocket can be pressed against the outside of the laces. The laces will be engaged by the hooks if the laces are made of cotton, nylon and other woven fabrics. If the shoe has laces made of solid plastic material, leather and the like, the hooks will not engage the material, and the flap which is placed under the laces will still hold the pouch in position.

While only two embodiments of the invention have been shown, it is believed that one skilled in the art may realize other embodiments; therefore, for a full and complete understanding of the invention, the drawings, description and claims should be considered fully.

What is claimed is:

1. A removable shoe packet pocket for securing to the laces of a shoe for carrying articles comprising:

a pocket body formed of a sheet of material folded to form a front side and a back side, said front side and said back side having peripheral edges sewn together to provide said pocket with an open end to receive articles;

a u-shaped loop member attached to said back side where said sheet of material forming said pocket body is folded and having a length to wrap around said open end of said pocket body and fastened to said front side; where said u-shaped loop member is passed between the shoe and the laces and pulled until said u-shaped loop member catches on the laces, where u-shaped loop member is attached to said back side, and where said u-shaped loop member covers said open end of said pocket body when folded and fastened to said front side of said pocket body; and a fastening means attached to said back side of said pocket body for removably engaging the laces of a shoe, where said fastening means is covered by said u-shaped loop member, and said fastening means having hooks of a hook and loop system for engaging the laces.

2. A shoe pocket as in claim 1, wherein said shoe pocket is constructed of a flexible material.

* * * * *